US005975240A

United States Patent [19]

O'Brien

[11] Patent Number: 5,975,240

[45] Date of Patent: Nov. 2, 1999

[54] PLATFORM FOR LADDERS

[76] Inventor: Sean O'Brien, Care of General Delivery, Dublin, Pa. 18917

[21] Appl. No.: 09/119,361

[22] Filed: Jul. 20, 1998

[51] Int. Cl.[6] ..... E06C 7/16

[52] U.S. Cl. ..... 182/122; 182/120; 182/116

[58] Field of Search ..... 182/120–122

[56] References Cited

U.S. PATENT DOCUMENTS

| | | | |
|---|---|---|---|
| 1,645,879 | 10/1927 | Skeels | 182/121 |
| 2,772,927 | 12/1956 | Woodward | 182/121 |
| 4,653,608 | 3/1987 | Casada | 182/121 |
| 5,465,809 | 11/1995 | Panicci | 182/121 |

*Primary Examiner*—Daniel P. Stodola
*Assistant Examiner*—Hugh B. Thompson
*Attorney, Agent, or Firm*—William F. Hamrock

[57] ABSTRACT

A safety platform foldable structure for a ladder for a worker to stand on. The platform structure has a platform flooring in the shape of the letter H which is removably mountable to one rung of an upstanding ladder to an open horizontal or vertical closed position. Spaced apart hook mechanisms extending from the flooring, are releasably secured to the rung to assist holding the platform in the horizontal position and to hold the platform in the vertical closed position. Downwardly extending front side walls from the flooring engage rails on the ladder to secure the platform in the horizontal position.

7 Claims, 5 Drawing Sheets

PLATFORM FOR LADDERS

CROSS REFERENCE TO RELATED APPLICATION

Not applicable

STATEMENT REGARDING FEDERALLY SPONSORED RESEARCH OR DEVELOPMENT

Not applicable

SUMMARY OF INVENTION

The invention relates to a stable safety platform for ladders and, more particularly, to a platform which is releasably attached to the ladders to securely stabilize working positions by being mounted securely on the rung and side rails of the ladder.

The safety of workers on ladders at a level of more than five feet above the ground requires a safe platform that is simple and easy to use and requires less handling. Many of the the platforms in the prior art have utilized complicated arrangements to mount the platform to the rungs of the ladder. Some of these complicated devices are extremely difficult and dangerous to operate and to attach to the rungs of the ladder. There is a need for an improved low cost safe platform for use by household and construction workers which provides a secure and safe platform which is simple and easy to operate and requires less handling. The present invention provides a safe and simple platform for use with ladders which overcomes many of the disadvantages of previous plateform structures.

In accordance with the platform of the present invention, there is provided a stable safety platform to safely support the worker on the ladder. The platform includes a flat platform flooring in the form of the letter H having a flat platform flooring cross section connected to the ladder. A pair of hook mechanisms hook around an upper rung to help support the platform flooring in a horizontal position and also permit swinging up and down movement of the platform so that it can be folded up on the ladder. Descending interior front wall sections extend downwardly from the platform flooring below the hook mechanisms which act as a wedge by engaging the ladder rails to secure the platform flooring in the horizontal position allowing the worker to be safely supported on the platform flooring.

DETAILED DESCRIPTION OF THE PREFERRED EMBODIMENT

The unique safety platform disclosed herein is not merely another complicated platform structure for workers to stand on when working with ladders. To the contrary, the unique safety platform of this invention performs several functions in a safe manner not previously obtainable with previous platforms. The unique combination of hook mechanisms with the front wall section functioning as a wedge permits quick and easy installing and removing of the platform on and from the ladder as well as provides a safe and stable work area. The platform can also be easily folded up to a vertical position on the ladder by the worker which provides a safe procedure of climbing up and descending from the ladder.

Figure 1:
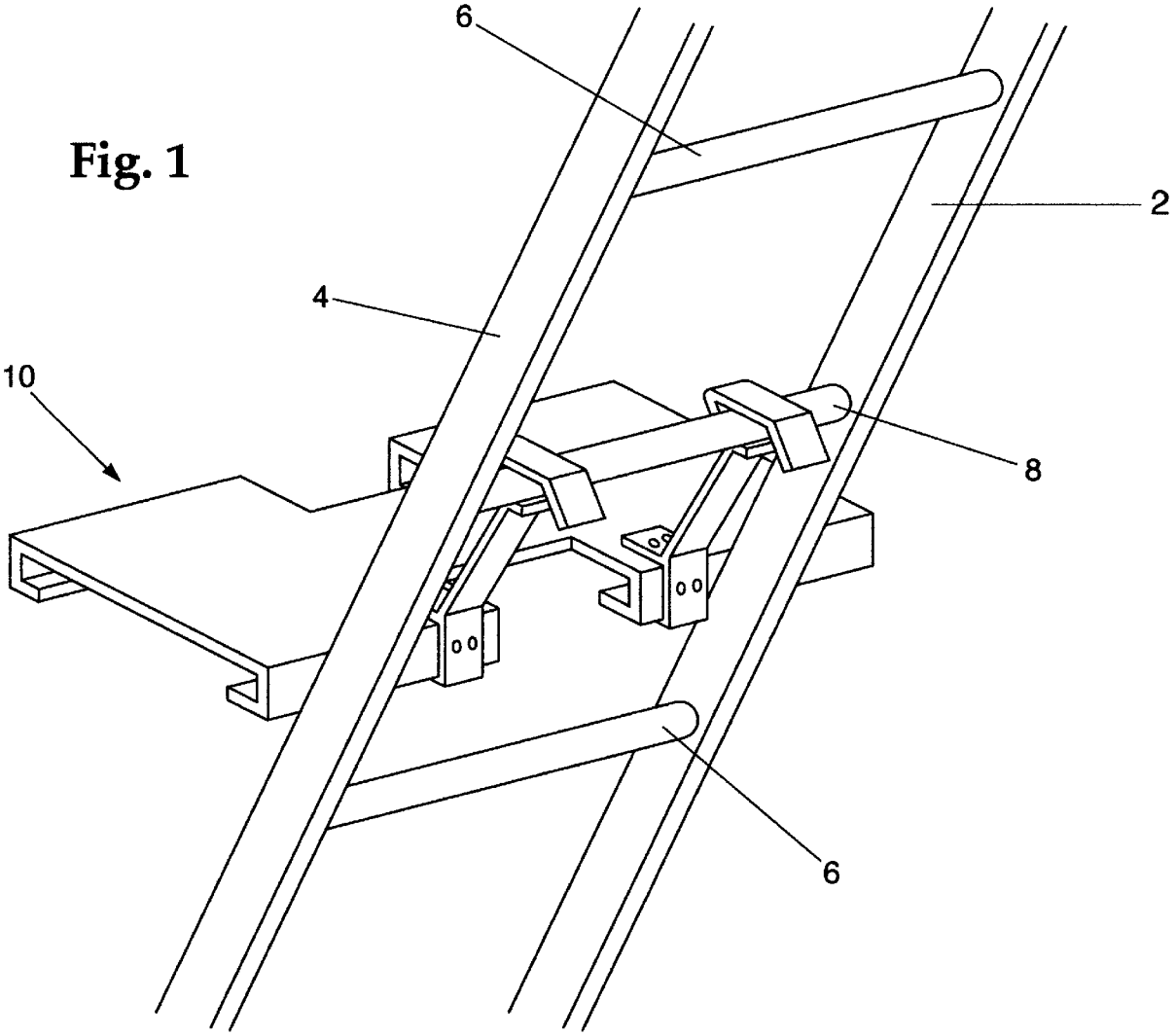
FIG. 1 is a perspective view partly in section of the safety platform mounted on a ladder.

The safety platform of the invention is used with conventional upstanding ladders which lean against the work area on a wall or building. In FIG. 1, there is shown a view of the safety platform 10 mounted on the ladder 2 wherein the safety platform is in the open working position which is in the horizontal position with respect to the ground. The ladder has vertical side rails 4 and a plurality of successively spaced horizontal rungs 6 and working rung 8 to which the safety platform is attached. Generally, working rung 8 is located about five rungs down from the top of the ladder which has been found to be the most convenient working position for workers on the ladder. Most recently, ladders are made with rectangular or square rungs and the safety platform of the invention is constructed to fit these rungs. The angle formed by the ladder leaning against the wall or building is generally about seven degrees more or less which appears to be the preferred and safest working angle for the position of upstanding ladders.

Figure 2:
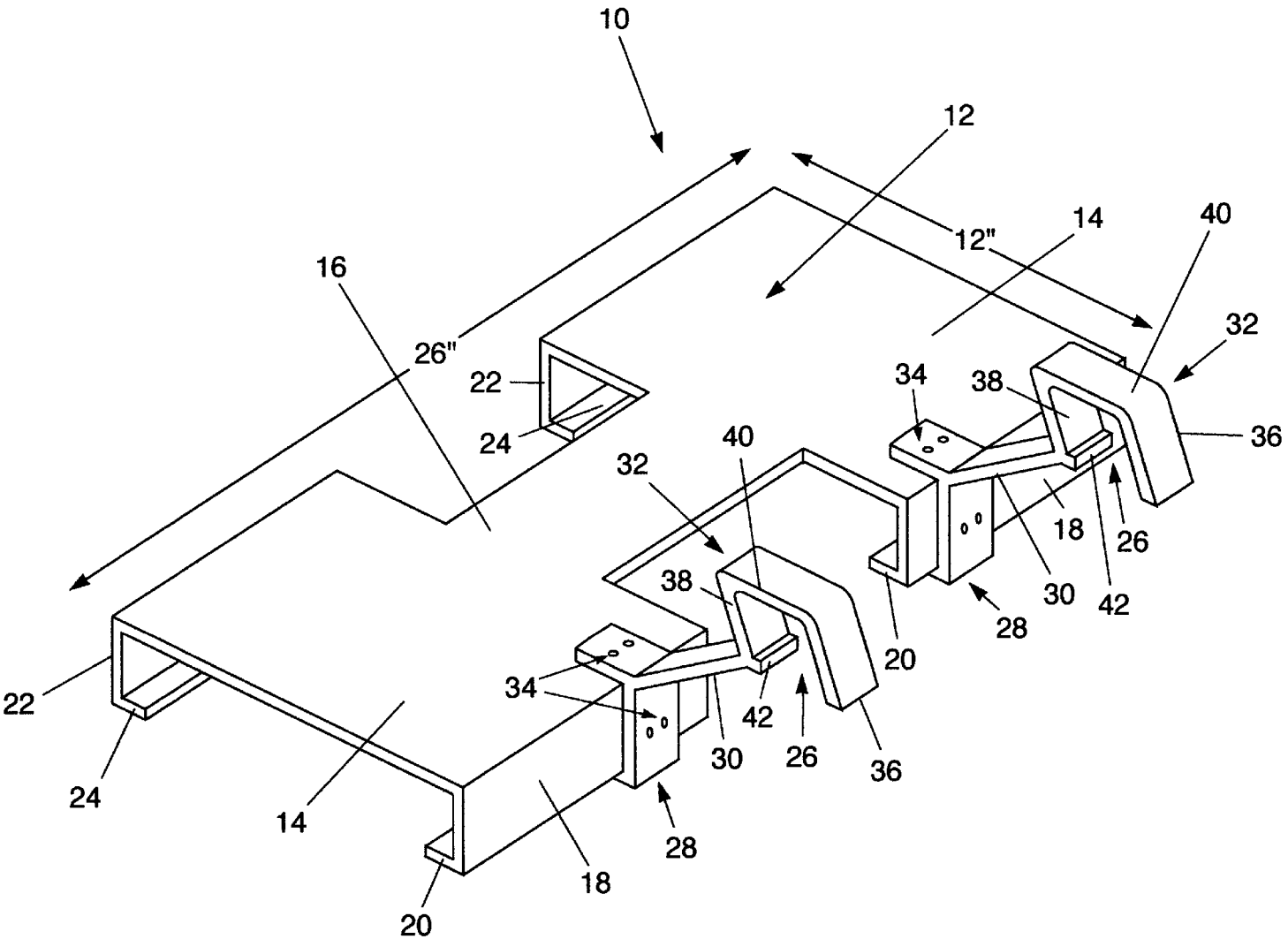
FIG. 2 is a perspective view of the safety platform.

Referring now to the drawings, shown in FIG. 1 is safety platform 10 in use removably attached to the ladder which is standing upright against the wall (not shown). Platform 10 as seen in FIGS. 1 and 2 includes a platform flooring having a top flat surface in the form of the letter H with sufficient surface area upon which a worker can stand. The platform can be structured from any durable material preferably ladder grade cast aluminum about one half inch in thickness or other similar durable material.

Safety platform 10 as shown in FIGS. 1 and 2 is removably supported in its open horizontal working position on rung 8 of the ladder 2. Safety platform 10 includes flat platform flooring 12 in the form of the letter H having two platform flooring side sections 14 and platform flooring cross section 16. Platform flooring 12 further includes front wall section 18 extending downwardly at approximately a right angle from flooring side section 14 terminating in front flat base section 20 at approximately a right angle therefrom. At the rear of the flooring, rear wall section 22 extends downwardly terminating in rear flat base 24.

Figure 3:
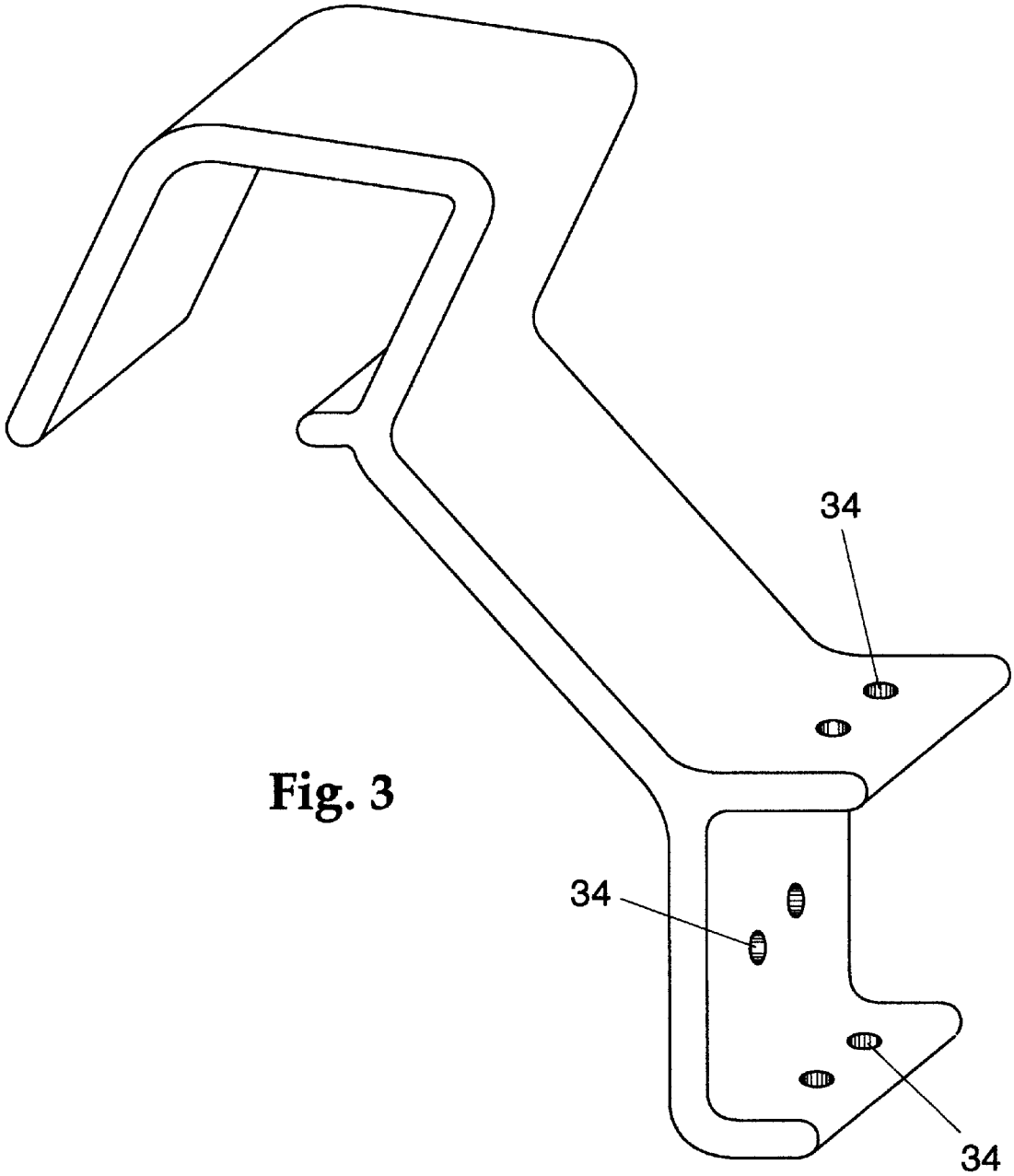
FIG. 3 is a perspective view of the hook mechanism.

Extending from the front end of side sections 14 of the platform are a pair of hinge mechanisms 26 shown in FIGS. 1, 2 and 3, each of which includes hook base support 28, hook arm 30 and hook element 32. Preferably, hook mechanism 26 is integrally constructed in one unit although other construction is acceptable. Hook base support 28 has a C-shaped configuration that closely engages the front portion of platform flooring side sections 14, front wall 18 and front flat base 20 and locks the hook support and hook mechanisms to the platform by various locking means 34 such as rivets or bolts or similar locking devices. Hook arm 30 extends from hook base support 28 upwarly at an angle terminating in hook element 32. The upward angle formed by hook arm 30 extending upwardly from the hook base support approximates the angle of the ladder leaning against the wall or building which is generally about seven degrees more or less. However, variations of the upward angle are permitted in order to place the platform flooring in a generally horizontal safe and secure working position.

Hook element 32 extends upwardly at an angle from hook arm 30. Hook 32 incorporates a multisided hook, preferably a three sided bottomless rectangular shaped hook element, having opposing downwardly extending front hook side 36 and rear hookside 38 joined together by top hook side 40. Front hook side 36 extends below opposing rear hook side 38 which includes protruding lip 42 extending inwardly at an angle. The combination of the longer length of front hook side 36 and protruding lip 42 enhances the securing of hook elements 32 to rung 8 when the platform is in the horizontal working position and in the vertical nonworking position. The upward angle of the hook arm in conjuntion with the angle of the hook element allows the underside of top hook side 40 to lie flat on, and to snugly engage, the flat top surface of the rectangular or square rung.

Figure 4:
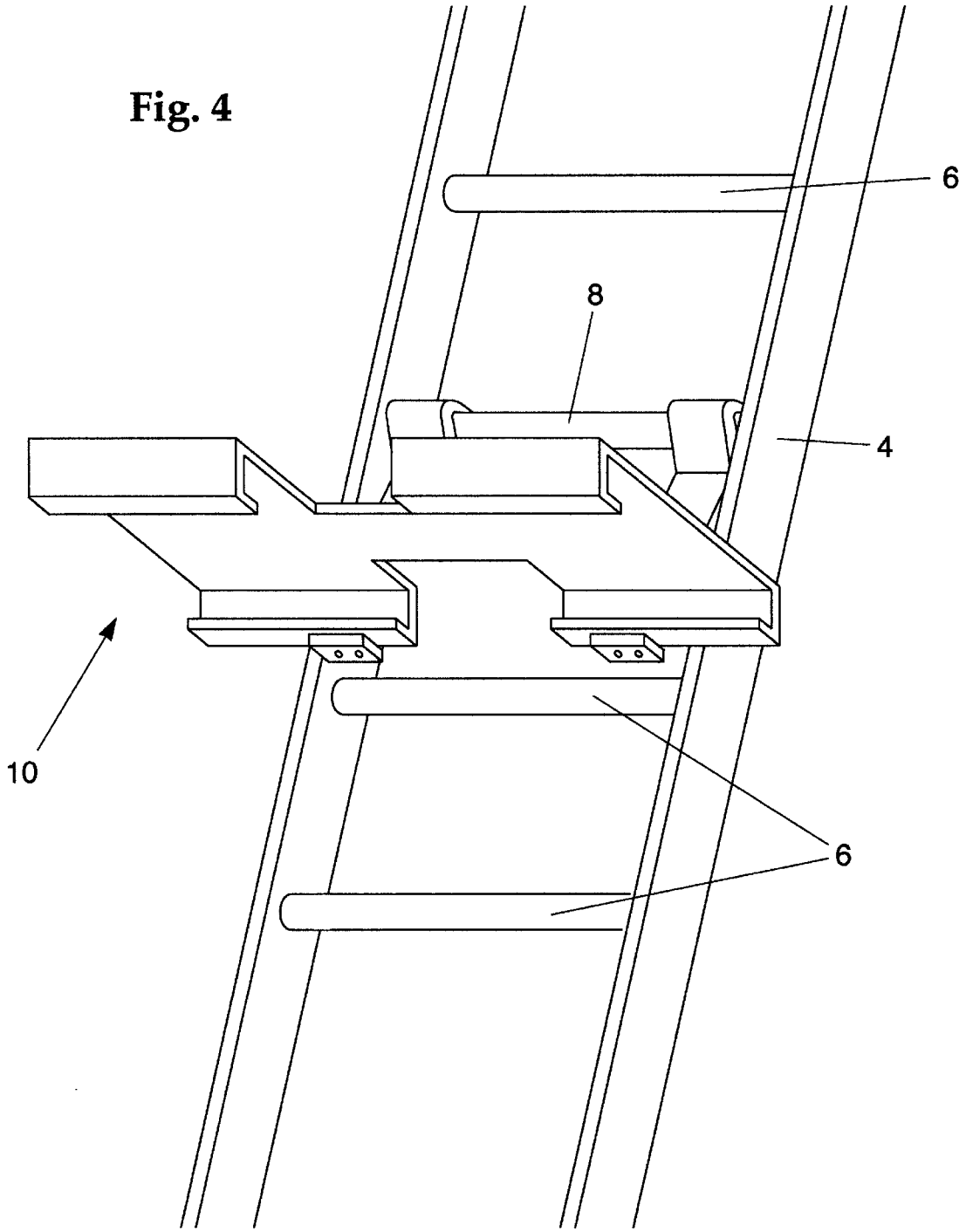
FIG. 4 is a bottom view of the safety platform.
Figure 5:
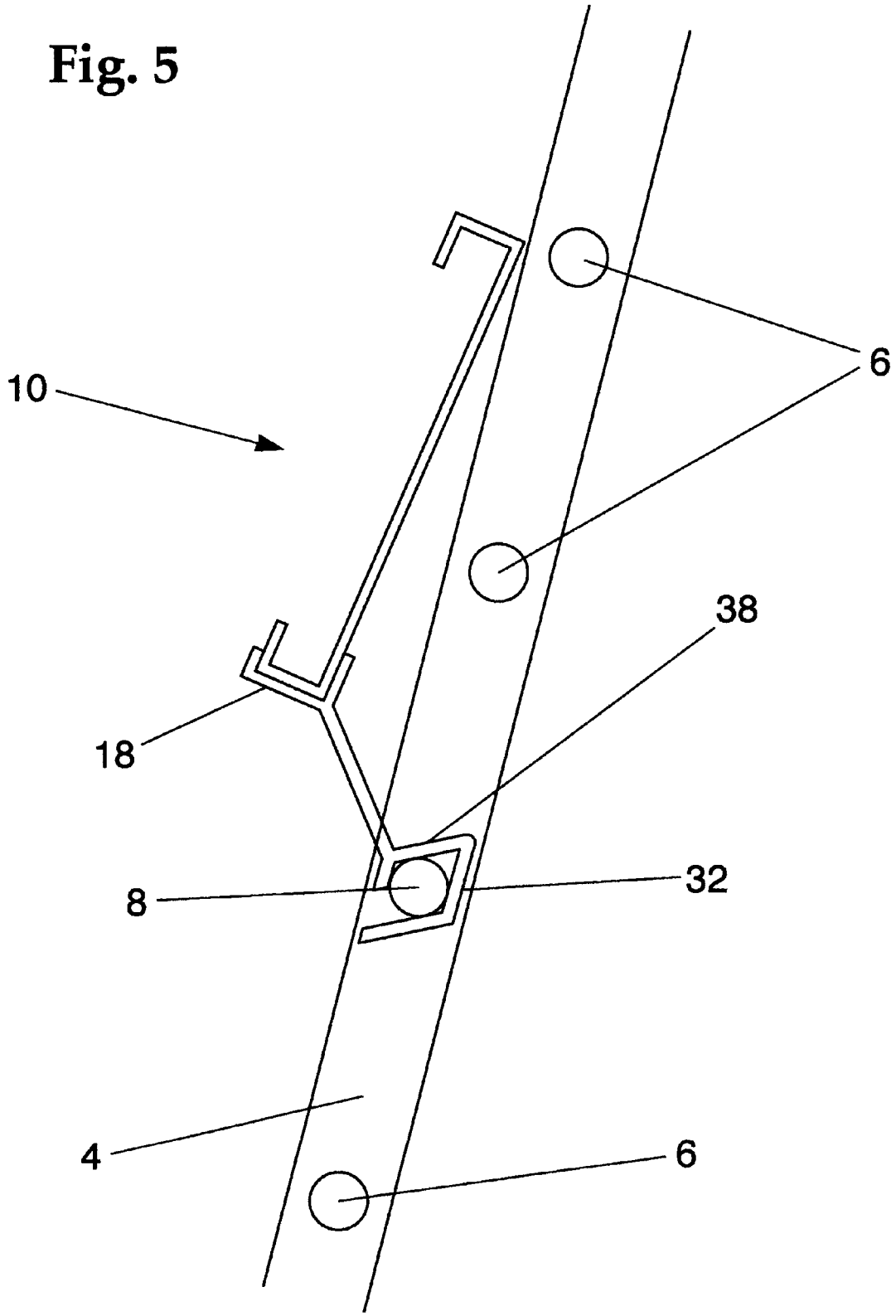
FIG. 5 is a side view of the safety platform folded up on a ladder.

The unique hook mechanism 26 and platform flooring 12 configuration of the invention permits the platform stucture to be easily manipulated on the ladder as shown in FIG. 5 to securely fold up the platform stucture on the ladder in the vertical position. Hook arm 30 terminates in the three sided rectangular shaped hook element 32 which encompasses rung 8 just inside each side rail 4 resulting in standing space on the rung of about twelve nches between the hook mechanisms. Front wall sections 22 extend downwardly at about right angles to flooring side sections 14 as seen in FIGS. 1, 2 and 4 on the rail side of each hook mechanism to firmly engage the rails when the platform is in the open horizontal working position on the ladder. The angle of the upwardly extending hook arm 30 preferably about seven degrees which is similar to the preferred angle in which the ladder is placed against the wall or a building. However, any angle of the hook arm is permitted which places the platform in the horizontal working position.

It is this unique configuration of the C-shaped hook base 28 secured to the flooring, the upwardly extending angled hook arm 30, the multisided hook element 32 encompassing the rung of the ladder, and the front wall section 18 firmly engaging the ladder rails which firmly support the safety platform structure secured to the ladder at a uniform horizontal position. Generally, the dimensions of the safety platform 10 are about twenty six inches wide and about twelve and one half inches from the front to the rear. The front and rear wall sections 18 and 22 extend about three inchs downwardly and the flat bases 20 and 24 extend inwardly about one half an inch.

Shown in FIGS. 1, 2, 4 and 5 is the attachment of the hook mechanism 26 to the platform flooring 14. C-shaped hook base support 28 is locked to the platform flooring by securing means 34 such as rivets or bolts or similar locking decices securing the base support to the flooring section 14, front wall section 18 and front flat base 20. The upwarly ascending angle of hook arm 32 is positioned to coincide with the angle of the ladder against the wall or building.

FIG. 5 is a side view of safety platform 10 in the closed nonworking position supported by the hook element on the rung of the ladder. The safety platform is placed in the vertical, closed, nonworking position by a worker while proceeding up or down the ladder.

In operation, the worker carries the platform up the ladder to the desiresd height which is generally about five rungs down from the top of the ladder. Upon reaching the desired height, the worker mounts the hook elements 32 on rung 8 folding up the platform in the vertical position above rung 8 whereby the interior of rear side 38 of the hook engages the rung to become the vertical resting point of the of the platform. The worker then proceeds upwardly stepping within the front and rear openings of central cross-section 16 to a higher rung 6. While supported on the higher rung, the work moves the platform with his foot allowing the platform to unfold by gravity downwardly into the open horizontal position with the hook elements encompassing rung 8 and front wall sections 18 engaging ladder rails 4 and thereby securing the platform in the horizontal working position. The worker then positions himself on the platform flooring.

As seen in FIG. 5, safety platform 10 is in the closed vertical nonworking position on the ladder. The worker is able to place the platform in this closed vertical position when standing on the open horizontal working position by stepping up to the higher rung 6 and lifting upwardly with his foot the central floor cross section so that the flooring side sections 16 lie flat vertically against the rails 4 above rung 8. The platform is now in the closed position. The worker is able to climb down the ladder without difficulty by stepping through the open areas in the cross-section to a lower rung.

Generally, safety platform 10 is about twenty-six inches in width to extend beyond each rail 4 of the the ladder. The combination of the H-shaped flat platform 12, the front wall section 18 and hook mechanism 26 stabilizes the platform structure so that the worker becomes less fatiqued by being able to stand up straight. The worker is then able to increase productivety and improve the quality of the work.

Having now described the invention, it will be apparent to one of ordinary skill in the art that many chages and modifications can be made without departing from spirit and scope of the invention as setforth herein.

What is claimed is:

1. A platform structure mounted on a ladder with side rails and rungs for a worker to stand on comprising a foldable platform structure releasably mountable on one rung of the ladder to an open horizontal working position or to a closed nonworking vertical position with respect to the ladder, said platform structure comprising a flat platform flooring in the form of the letter H comprising latterally spaced apart side sections with front and rear ends and interconnected cross section, said side sections having downwardly extending front wall sections extending across their entire length and beyond the width of said side rails substantially below said one rung and slightly above the next lower rung when the platform structure is in the open horizontal working position, spaced apart hook mechanisms comprising an arm extending substantially upwardly at an angle from each side section terminating at an upward angle in a three sided hook element mountable on said one rung of the ladder wherein the front side of the hook element extends lower than the rear side and the rear side of the hook element terminates in a protuding lip.

2. A platform structure according to claim 1 wherein said hook element comprises a bottomless rectangular shaped hook element having a top side joining together opposing downwardly extending front and rear sides.

3. A platform structure according to claim 2 where in the open horizontal position the upwardly extending angles of the arm and the hook element combine to position the top side of the hook element on the rung.

4. A platform structure according to claim 3 where in the closed vertical position the rear side of the hook element engages the rung.

5. A platform structure according to claim 1 wherein the platform structure is made of metal.

6. A platform structure according to claim 5 wherein the platform structure is made of aluminum.

7. A platform structure according to claim 6 wherein the ladder rungs have a rectangular construction.

* * * * *